US010480508B2

(12) United States Patent
Matsui et al.

(10) Patent No.: US 10,480,508 B2
(45) Date of Patent: Nov. 19, 2019

(54) SCROLL COMPRESSOR

(71) Applicant: Mitsubishi Electric Corporation, Tokyo (JP)

(72) Inventors: Tomokazu Matsui, Tokyo (JP); Yuji Takamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 116 days.

(21) Appl. No.: 15/526,417

(22) PCT Filed: Feb. 12, 2015

(86) PCT No.: PCT/JP2015/053750
§ 371 (c)(1),
(2) Date: May 12, 2017

(87) PCT Pub. No.: WO2016/129070
PCT Pub. Date: Aug. 18, 2016

(65) Prior Publication Data
US 2017/0314557 A1 Nov. 2, 2017

(51) Int. Cl.
*F04C 18/02* (2006.01)
*F04C 29/00* (2006.01)
*F01C 21/02* (2006.01)

(52) U.S. Cl.
CPC ..... *F04C 18/0215* (2013.01); *F04C 29/0057* (2013.01); *F04C 2210/263* (2013.01); *F04C 2240/50* (2013.01); *F04C 2240/60* (2013.01)

(58) Field of Classification Search
CPC ..... F04C 18/0215; F04C 29/0021; F04C 29/0057; F04C 2240/50; F04C 2240/807; F01C 21/02
See application file for complete search history.

(56) References Cited

U.S. PATENT DOCUMENTS 4,431,327 A * 2/1984 Mazzagatti ..... F16D 1/06 403/11
5,328,342 A * 7/1994 Ishii ..... F04C 29/0057 418/55.5

(Continued)

FOREIGN PATENT DOCUMENTS

JP H10-281083 A 10/1998

OTHER PUBLICATIONS

Center of Mass in Two Dimensions, by JL Stanbrough, Feb. 1, 2010.*

(Continued)

*Primary Examiner* — Deming Wan
(74) *Attorney, Agent, or Firm* — Posz Law Group, PLC

(57) ABSTRACT

A scroll compressor includes a compressing mechanism unit including a fixed scroll that is fixedly provided in a shell and an orbiting scroll that moves around the fixed scroll, the compressing mechanism unit compressing fluid; a main shaft including an eccentric shaft portion at one end thereof that transmits a rotational driving force to the orbiting scroll; a slider having a slide groove in which the eccentric shaft portion is slidably fitted; and an orbital bearing provided to the orbiting scroll that rotatably supports the slider. The slider is provided on the inner peripheral side of the orbital bearing when seen in a direction of a center axis of the slider. The center axis of the slider is eccentric in one direction from an axis of rotation of the main shaft and a center of gravity of the slider is eccentric in an opposite direction.

7 Claims, 6 Drawing Sheets

(56) References Cited

U.S. PATENT DOCUMENTS

| | | | | |
|---|---|---|---|---|
| 5,362,218 | A * | 11/1994 | Fukanuma | F04C 18/0215 418/151 |
| 5,474,434 | A * | 12/1995 | Wada | F04C 15/0065 418/55.5 |
| 5,536,152 | A * | 7/1996 | Kawahara | F04C 28/28 418/55.5 |
| 6,354,822 | B1 | 3/2002 | Lifson et al. | |
| 2011/0011123 | A1* | 1/2011 | Matsuura | C09K 5/045 62/468 |

OTHER PUBLICATIONS

Extended European Search Report dated Aug. 8, 2018 issued in corresponding EP patent application No. 15881945.8.
International Search Report of the International Searching Authority dated May 19, 2015 for the corresponding international application No. PCT/JP2015/053750 (and English translation).

* cited by examiner

SCROLL COMPRESSOR

CROSS REFERENCE TO RELATED APPLICATION

This application is a U.S. national stage application of PCT/JP2015/053750 filed on Feb. 12, 2015, the contents of which are incorporated herein by reference.

TECHNICAL FIELD

The present invention relates to a scroll compressor.

BACKGROUND ART

A scroll compressor includes a compressing mechanism unit in which scroll laps included in a fixed scroll and an orbiting scroll, respectively, are in mesh with each other. Rotational power generated by a rotational mechanism unit that is provided separately is transmitted to the compressing mechanism unit through a main shaft. The orbiting scroll is eccentric from the axis of rotation of the main shaft and makes an orbital motion while being prevented from rotating on its own axis by a rotation-preventing mechanism that is provided separately. In the compressing mechanism unit, the orbiting scroll orbits the fixed scroll, whereby fluid is compressed.

A known scroll compressor includes a follower crank mechanism in which the sealability of a compression chamber is improved with a scroll lap of a fixing scroll and a scroll lap of an orbiting scroll being pressed against each other under a centrifugal force (see Patent Literature 1, for example).

CITATION LIST

Patent Literature

Patent Literature 1: Japanese Unexamined Patent Application Publication No. 10-281083

SUMMARY OF INVENTION

Technical Problem

The scroll compressor according to Patent Literature 1 employs a balance-weighted slider. The balance-weighted slider includes a slider portion positioned on the inner peripheral side of an orbital bearing, and a balance weight portion positioned on the outer peripheral side of the orbital bearing, the slider portion and the balance weight portion being continuous with each other. The center of gravity of the balance-weighted slider is eccentric in a direction opposite to the direction in which the orbiting scroll is eccentric. Hence, part or the whole of the centrifugal force acting on the orbiting scroll is cancelled out by the centrifugal force acting on the balance-weighted slider. Therefore, the forces that press the scroll laps against each other can be prevented from becoming excessively large.

In the scroll compressor according to Patent Literature 1, however, the balance weight portion projects to the outer side of the orbital bearing. Therefore, when the balance-weighted slider rotates, the balance weight portion rotates on the outer side of the orbital bearing. Accordingly, lubricant accumulated in a frame is stirred at a high speed by the balance weight portion. Such a situation causes a problem that the power loss due to the viscous drag exerted by the lubricant increases and therefore deteriorates the performance of the scroll compressor.

The present invention is to solve the above problem and provides a scroll compressor exhibiting improved performance.

Solution to Problem

A scroll compressor according to an embodiment of the present invention includes a compressing mechanism unit including a fixed scroll fixed in a shell and an orbiting scroll configured to move around the fixed scroll, the compressing mechanism unit being configured to compress fluid; a main shaft including an eccentric shaft portion at one end and being configured to transmit a rotational driving force to the orbiting scroll; a slider having a slide groove in which the eccentric shaft portion is slidably fitted; and an orbital bearing provided to the orbiting scroll and rotatably supporting the slider, the slider being provided on an inner peripheral side of the orbital bearing when seen in a direction of a center axis of the slider, the center axis of the slider being eccentric in one direction from an axis of rotation of the main shaft, and a center of gravity of the slider being eccentric in a direction opposite to the one direction from the axis of rotation of the main shaft.

Advantageous Effects of Invention

According to the embodiment of the present invention, the slider positioned on the inner peripheral side of the orbital bearing also serves as a balance weight. Hence, the power loss due to the viscous drag exerted by the lubricant can be reduced. Consequently, the performance of the scroll compressor can be improved.

DESCRIPTION OF EMBODIMENT

Embodiment

Figure 1:
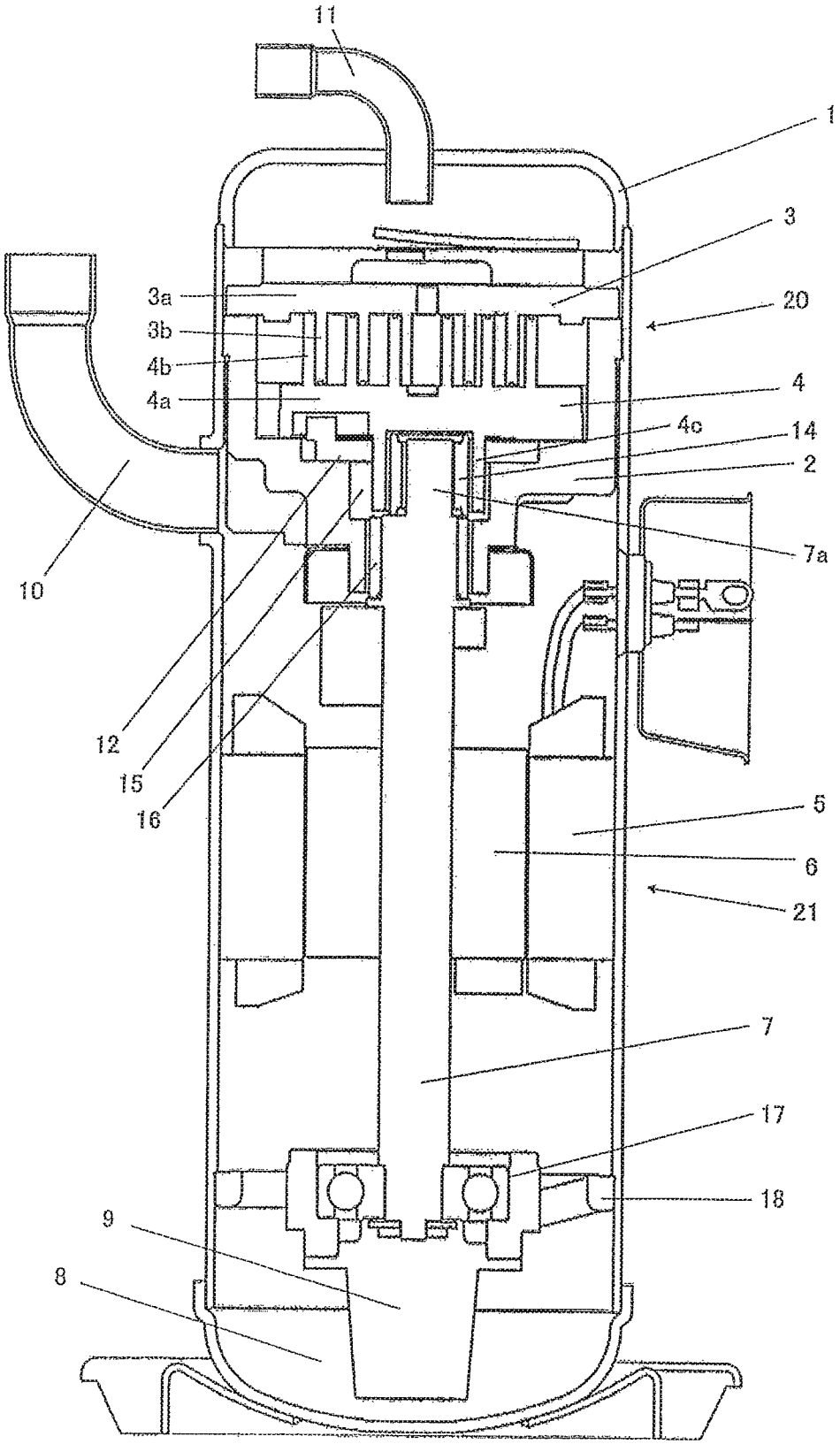
FIG. 1 is a schematic vertical sectional view of a scroll compressor on the basis of which Embodiment of the present invention is discussed.

A scroll compressor according to Embodiment of the present invention will now be described. FIG. 1 is a schematic vertical sectional view of a scroll compressor on the basis of which Embodiment is discussed. The scroll compressor is one of elements included in a refrigeration cycle included in various industrial machines such as refrigerators, freezers, vending machines, air-conditioning apparatuses, refrigeration apparatuses, and hot-water-supplying apparatuses. Note that the relative dimensions, the shapes, and other factors of elements illustrated in the drawings to be referred to below, including FIG. 1, may be different from actual ones. In addition, the relative positions (such as relative positions in the vertical direction) of the elements to be described below are basically described on the premise that the scroll compressor is set in a state of use.

As illustrated in FIG. 1, the scroll compressor includes a compressing mechanism unit 20 that compresses fluid (for example, refrigerant circulating in a refrigeration cycle), an electric motor unit 21 that drives the compressing mechanism unit 20, and a shell 1 as an airtight container that houses the compressing mechanism unit 20 and the electric motor unit 21. The compressing mechanism unit 20 is positioned in an upper part of the shell 1. The electric motor unit 21 is positioned on the lower side with respect to the compressing mechanism unit 20 (for example, near a central part of the shell 1 in the vertical direction).

The compressing mechanism unit 20 includes a fixed scroll 3 that is fixed to the shell 1 with a frame 2 interposed therebetween, and an orbiting scroll 4 that moves around (orbits) the fixed scroll 3. The fixed scroll 3 includes a base plate 3*a*, and a scroll lap 3*b* standing on one side of the base plate 3*a*. The orbiting scroll 4 includes a base plate 4*a*, and a scroll lap 4*b* standing on one side of the base plate 4*a*. The fixed scroll 3 and the orbiting scroll 4 are assembled such that the respective scroll laps 3*b* and 4*b* are in mesh with each other. A compression chamber in which fluid is to be compressed is provided between the scroll lap 3*b* and the scroll lap 4*b*. The base plate 4*a* has a hollow cylindrical boss portion 4*c* in a central part on a side thereof opposite the side having the scroll lap 4*b*. An orbital bearing 14 is provided along the inner surface of the boss portion 4*c*.

An Oldham ring 12 is provided between the orbiting scroll 4 and the frame 2. The Oldham ring 12 includes a ring portion, a pair of Oldham keys provided on the upper surface of the ring portion, and another pair of Oldham keys provided on the lower surface of the ring portion. The Oldham keys on the upper surface are fitted in respective key grooves provided in the orbiting scroll 4 and are slidable in one direction. The Oldham keys on the lower surface are fitted in respective key grooves provided in the frame 2 and are slidable in a direction intersecting the one direction. Such a configuration allows the orbiting scroll 4 to make an orbital motion without rotating on its own axis.

The electric motor unit 21 includes a stator 5 fixed to the inner periphery of the shell 1, a rotor 6 provided on the inner peripheral side of the stator 5, and a main shaft 7 fixed to the rotor 6. When the stator 5 is energized, the rotor 6 rotates together with the main shaft 7. An upper part of the main shaft 7 is rotatably supported by the frame 2 with a main bearing unit 16 interposed therebetween. A lower part of the main shaft 7 is rotatably supported by a sub-frame 18 with a sub-bearing unit 17 interposed therebetween. The main shaft 7 includes an eccentric shaft portion 7*a* at the upper end thereof. The eccentric shaft portion 7*a* is fitted in the orbital bearing 14.

The shell 1 stores lubricant 8 at the bottom thereof. The main shaft 7 is provided at the lower end thereof with a pump 9 that pumps the lubricant 8. The main shaft 7 has thereinside a pumping hole (not illustrated) extending in the axial direction thereof. The lubricant 8 pumped by the pump 9 flows through the pumping hole and is supplied to an oil sump 15 provided in the frame 2 and to relevant sliding parts.

The shell 1 is provided with a suction pipe 10 through which low-pressure refrigerant gas is taken from the outside, and a discharge pipe 11 through which compressed high-pressure refrigerant gas is discharged to the outside.

An operation of the scroll compressor will now be described. When electricity is supplied to the stator 5 from an external power source, the rotor 6 rotates. A rotational driving force generated by the rotor 6 is transmitted to the orbiting scroll 4 through the main shaft 7. The orbiting scroll 4, which is prevented from rotating on its own axis by the Oldham ring 12, orbits the fixed scroll 3. Meanwhile, low-pressure refrigerant gas taken from the suction pipe 10 is continuously taken into the compression chamber provided between the scroll lap 3*b* of the fixed scroll 3 and the scroll lap 4*b* of the orbiting scroll 4, whereby a process including suction, compression, and discharge is repeatedly performed. The lubricant 8 stored at the bottom of the shell 1 is pumped by the pump 9 with the rotation of the main shaft 7 and is supplied to the oil sump 15 in the frame 2 and to relevant sliding parts. The lubricant supplied to the oil sump 15 and to the sliding parts returns to the bottom of the shell 1 under the gravitational force.

Figure 2:
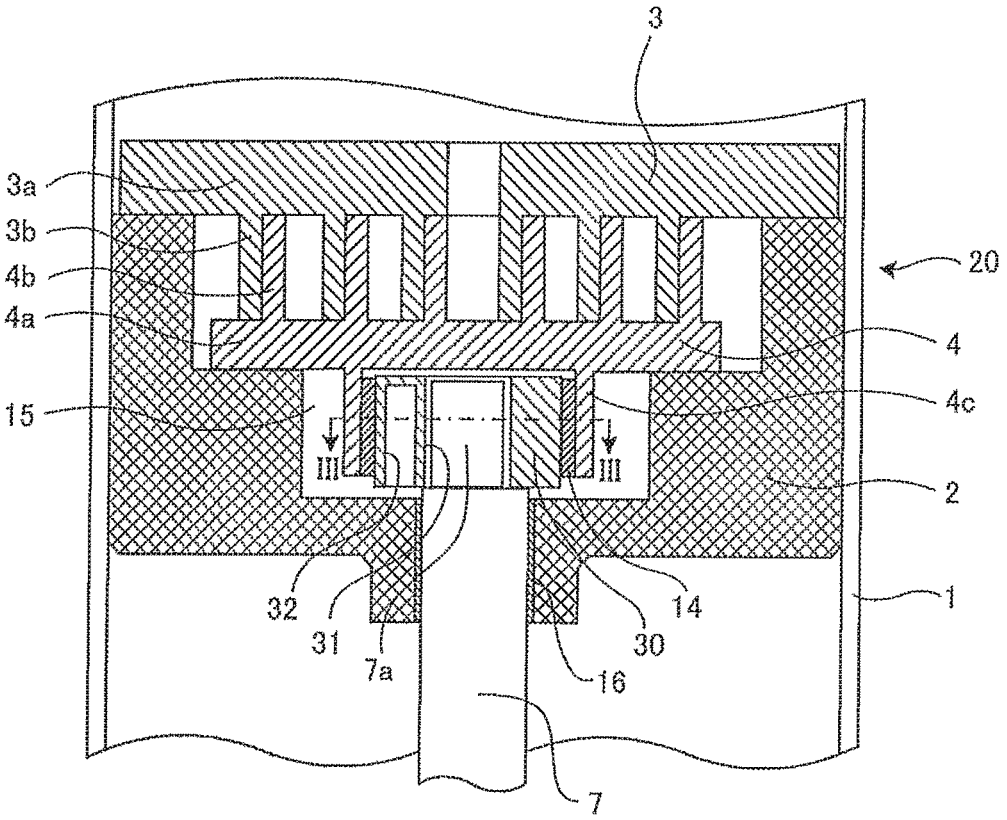
FIG. 2 is a schematic sectional view of a compressing mechanism unit 20 included in the scroll compressor according to Embodiment of the present invention.

A configuration of the compressing mechanism unit 20 included in the scroll compressor according to Embodiment will now be described, focusing on differences from the scroll compressor illustrated in FIG. 1. FIG. 2 is a schematic sectional view of the compressing mechanism unit 20 included in the scroll compressor according to Embodiment. As illustrated in FIG. 2, the base plate 4*a* of the orbiting scroll 4 has the hollow cylindrical boss portion 4*c* in the central part on the side thereof opposite the side having the scroll lap 4*b*. The boss portion 4*c* is provided with the orbital bearing 14 along the inner peripheral surface. The eccentric shaft portion 7*a* (a shaft pin) at the upper end of the main shaft 7 is fitted in the orbital bearing 14 with the slider 30 interposed therebetween.

Figure 3:
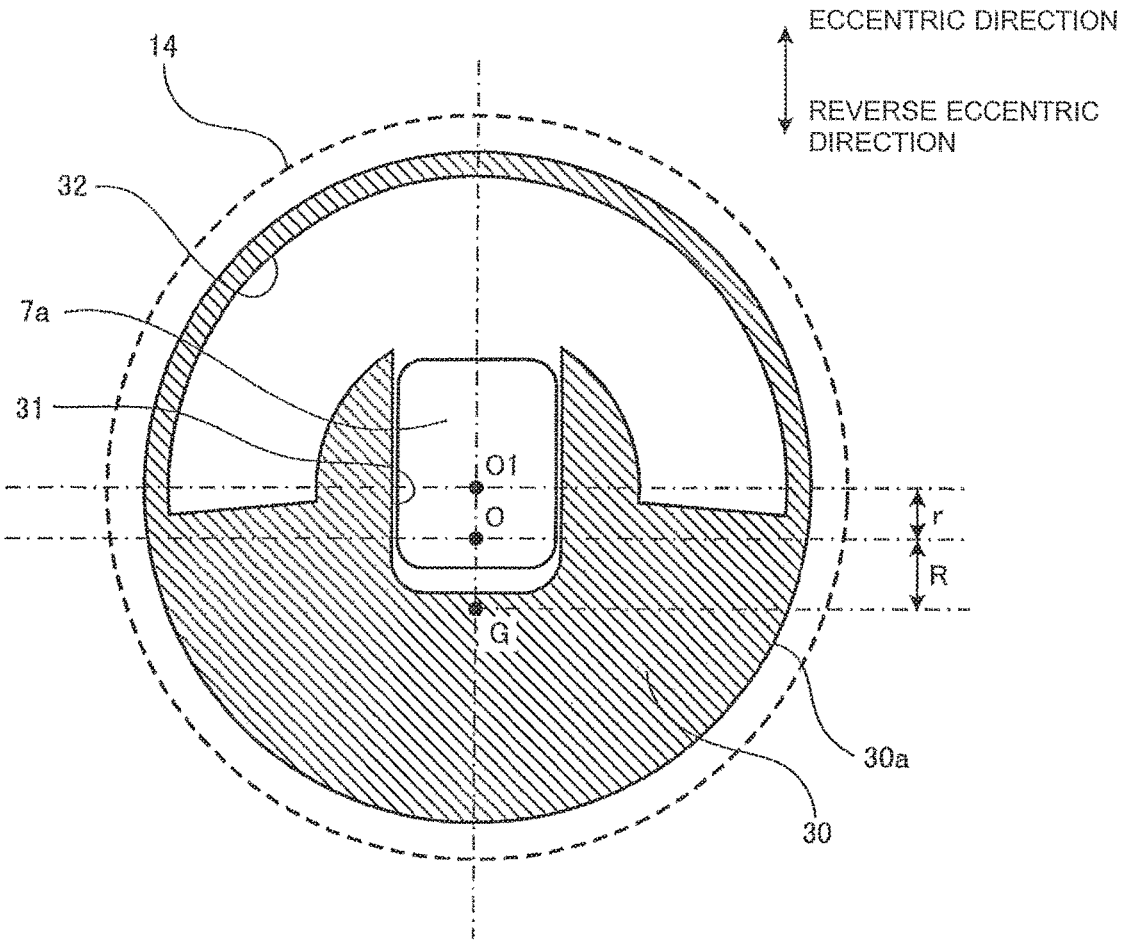
FIG. 3 is a sectional view of a slider 30 illustrated in FIG. 2 that is taken along line III-Ill.

FIG. 3 is a sectional view of the slider 30 illustrated in FIG. 2 that is taken along line III-III. FIG. 3 illustrates relative positions of the main shaft 7 and the slider 30 when the compressor is in operation. When the compressor is in operation, the slider 30 is rotated together with the main shaft 7 about an axis of rotation O thereof by a follower crank mechanism while being eccentric from an axis of rotation O of the main shaft 7 by an orbital radius r of the orbiting scroll 4. As illustrated in FIG. 3, the slider 30 has a cylindrical outer peripheral surface 30*a*. The outer peripheral surface 30*a* of the slider 30 is rotatably supported by the orbital bearing 14. Therefore, the distance between the center axis O1 of the outer peripheral surface 30*a* of the slider 30 and the axis of rotation O when the compressor is in operation is substantially equal to the orbital radius r.

The compressor is operated with the center axis O1 of the slider 30 being eccentric in one direction (the upward direction in FIG. 3) from the axis of rotation O of the main shaft 7. Hereinafter, the direction in which the center axis O1 of the slider 30 is eccentric from the axis of rotation O of the main shaft 7 is occasionally referred to as "the eccentric direction" and the direction opposite to the eccentric direction is occasionally referred to as "the reverse eccentric direction." The slider 30 is positioned on the inner peripheral side of the orbital bearing 14 (for example, only on an inner peripheral side of the orbital bearing 14) when seen along the center axis O1.

The slider 30 has a slide groove 31 in which the eccentric shaft portion 7*a* is fitted in such a manner as to be slidable in one direction. According to Embodiment, the direction of sliding of the eccentric shaft portion 7*a* is the same as the eccentric direction. Alternatively, the direction of sliding of the eccentric shaft portion 7*a* may be inclined with respect to the eccentric direction.

The slider 30 forms a follower crank mechanism in which the orbital radius of the orbiting scroll 4 is variable under the centrifugal force generated by the orbital motion of the orbiting scroll 4. The follower crank mechanism allows the side surface of the scroll lap 4*b* of the orbiting scroll 4 and the side surface of the scroll lap 3*b* of the fixed scroll 3 to be pressed against each other, whereby the sealability of the compression chamber can be improved.

The slider 30 has a semi-arc hollow portion 32 extending along the outer peripheral surface 30*a*. The hollow portion 32 is continuous with the slide groove 31. Most part of the hollow portion 32 is on the eccentric side with respect to the center axis O1 of the slider 30. The entirety of the hollow portion 32 may be on the eccentric side with respect to the center axis O1. The hollow portion 32 may be a through hole extending through the slider 30 in the axial direction or may be a non-through hole such as a recess or a counterbore. Since the hollow portion 32 is provided, a center of gravity G of the slider 30 is eccentric in the reverse eccentric direction from the axis of rotation O of the main shaft 7.

In the scroll compressor including the follower crank mechanism, if the rotation speed is increased or if the weight of the orbiting scroll 4 is increased with, for example, an increase in the density of the material thereof, the force that presses the side surface of the scroll lap 4*b* of the orbiting scroll 4 and the side surface of the scroll lap 3*b* of the fixed scroll 3 against each other may become excessively large. In such a situation, the frictional force between the side surfaces of the scroll laps 4*b* and 3*b* increases, and the power of the scroll compressor increases significantly. To avoid such a situation, according to Embodiment, the center of gravity G of the slider 30 is eccentric in the reverse eccentric direction. Therefore, part of the centrifugal force acting on the orbiting scroll 4 can be cancelled out by the centrifugal force acting on the slider 30. Hence, according to Embodiment, the force of pressing the side surfaces of the scroll laps 4*b* and 3*b* against each other can be prevented from becoming excessively large. To cancel out a satisfactory amount of centrifugal force even in high-speed operation, a distance R between the center of gravity G of the slider 30 and the axis of rotation O of the main shaft 7 is desirably longer than the distance r between the center axis O1 of the slider 30 and the axis of rotation O of the main shaft 7 (R>r).

Figure 4:
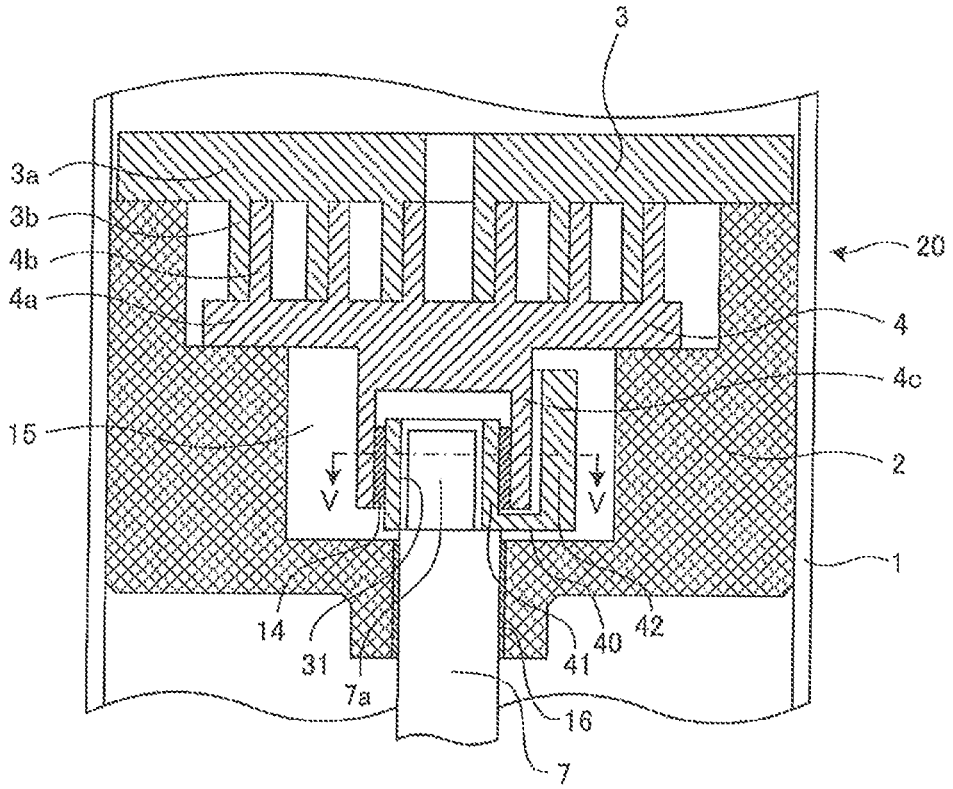
FIG. 4 Related Art
FIG. 4 is a schematic sectional view of a compressing mechanism unit 20 included in a scroll compressor assumed from the description of Patent Literature 1.
Figure 5:
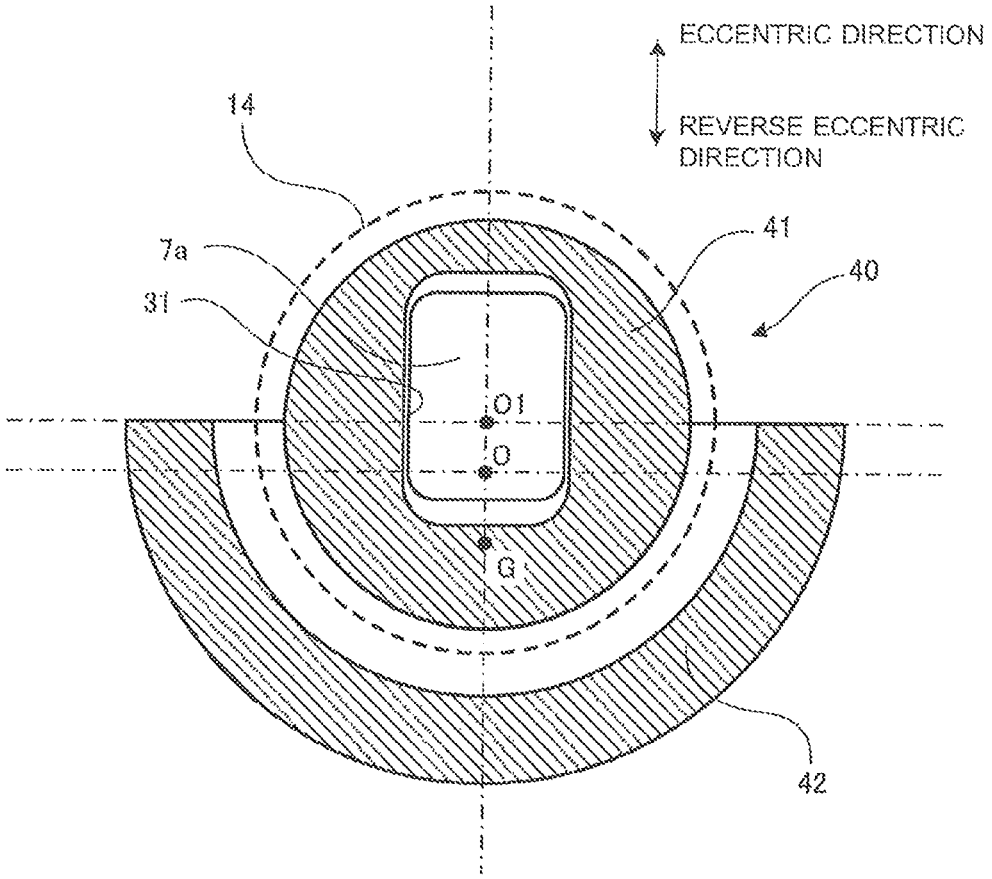
FIG. 5 Related Art
FIG. 5 is a sectional view of a balance-weighted slider 40 illustrated in FIG. 4 that is taken along line V-V.

FIG. 4 is a schematic sectional view of a compressing mechanism unit 20 included in a scroll compressor assumed from the description of Patent Literature 1. FIG. 5 is a sectional view of a balance-weighted slider 40 illustrated in FIG. 4 that is taken along line V-V. As illustrated in FIGS. 4 and 5, the scroll compressor includes a follower crank mechanism, as with the scroll compressor according to Embodiment. The balance-weighted slider 40 includes a slider portion 41 positioned on the inner peripheral side of an orbital bearing 14, and a balance weight portion 42 positioned on the outer peripheral side of the orbital bearing 14, the slider portion 41 and the balance weight portion 42 being continuous with each other. The center of gravity G of the balance-weighted slider 40 is eccentric in the reverse eccentric direction from the axis of rotation O of the main shaft 7. The balance weight portion 42 projects to the outer peripheral side of the orbital bearing 14 and the boss portion 4*c* and is positioned in the oil sump 15. Therefore, when the balance-weighted slider 40 rotates, the balance weight portion 42 rotates in the oil sump 15. Hence, the lubricant accumulated in the oil sump 15 is stirred at a high speed by the balance weight portion 42. Consequently, the power loss due to the viscous drag exerted by the lubricant increases particularly in high-speed operation.

To reduce such power loss, the number of oil-draining holes provided in the frame 2 may be increased so that the amount of oil retained in the oil sump 15 is reduced. However, if the number of oil-draining holes is increased, the balance of resistance in the oil-supplying path is disturbed. Consequently, a lack of oil may occur at relevant sliding parts in low-speed operation. Hence, it is difficult to reduce the power loss occurring as above in the scroll compressor illustrated in FIGS. 4 and 5.

On the other hand, in the scroll compressor according to Embodiment illustrated in FIGS. 2 and 3, the slider 30 housed in the orbital bearing 14 can serve as a balance weight. Therefore, the balance weight portion 42 does not need to project to the outer peripheral side of the orbital bearing 14 and the boss portion 4*c*. Hence, the lubricant is prevented from being stirred by the balance weight portion 42. Accordingly, the power loss due to the viscous drag exerted by the lubricant can be reduced. Thus, according to Embodiment, the performance of the scroll compressor can be improved particularly in high-speed operation.

Furthermore, in the scroll compressor illustrated in FIGS. 4 and 5, the centrifugal force of the balance weight portion 42 acts on the connection between the slider portion 41 and the balance weight portion 42. Therefore, the connection may be broken because of a lack of strength thereof. Moreover, the balance-weighted slider 40 has a complicated structure. Therefore, for example, to form the balance-weighted slider 40 as an integral body, the manufacturing cost and the processing time increase. In addition, to prevent the interference of the slider portion 41 with the orbital bearing 14, the balance weight portion 42 for adjusting the position of the center of gravity of the balance-weighted slider 40 needs to be made to extend in the axial direction (see FIG. 4). Consequently, the size of the scroll compressor increases in the axial direction.

In contrast, in the scroll compressor according to Embodiment illustrated in FIGS. 2 and 3, since the slider 30 has the hollow portion 32 and thus serves as a balance weight, the problem of the lack of strength at the connection between the slider portion 41 and the balance weight portion 42 is solved. Furthermore, in the scroll compressor according to Embodiment, since the slider 30 has a simple shape, the manufacturing cost and the processing time can be reduced, enabling mass production. Moreover, in the scroll compressor according to Embodiment, since the position of the center of gravity of the slider 30 in the axial direction is adjustable easily, the interference of the slider portion 41 with the orbital bearing 14 can be prevented without making the balance weight portion 42 extend in the axial direction. Consequently, according to Embodiment, the size of the scroll compressor can be reduced in the axial direction.

In general, a refrigeration cycle employing a low-GWP refrigerant tends to have a low refrigeration capacity because of the characteristics of the refrigerant. Therefore, to increase the refrigeration capacity of such a refrigeration cycle, the amount of refrigerant to be taken into the compression chamber needs to be increased, and the upper limit of rotation speed of the compressor needs to be made higher so that the compressor can be operated at a high speed. According to Embodiment, since the performance of the scroll compressor can be improved particularly in high-speed operation, applying the scroll compressor to a refrigeration cycle employing a low-GWP refrigerant such as an HFO refrigerant can produce a particularly great advantageous effect.

Figure 6:
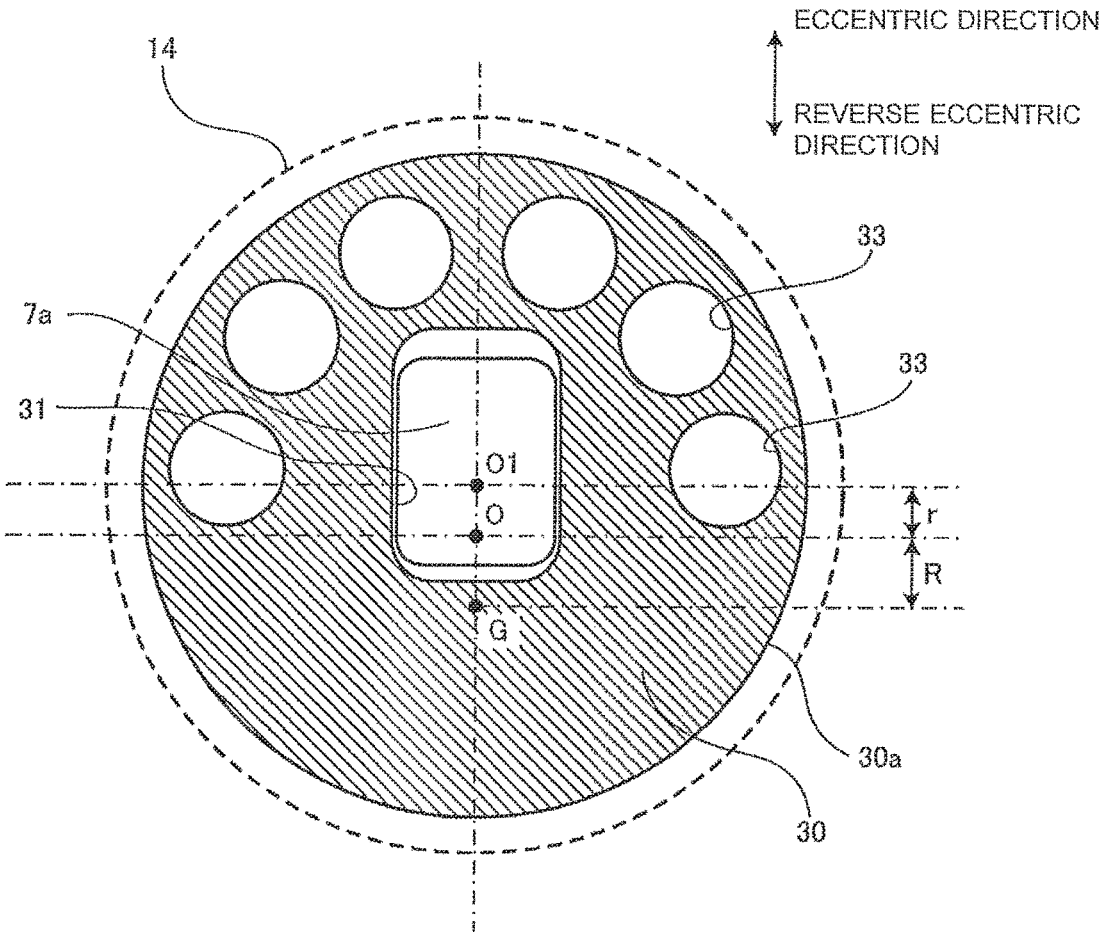
FIG. 6 is a sectional view of a modification of the slider 30 included in the scroll compressor according to Embodiment of the present invention.

FIG. 6 is a sectional view of a modification of the slider 30 included in the scroll compressor according to Embodiment. FIG. 6 illustrates a section corresponding to that illustrated in FIG. 3. As illustrated in FIG. 6, the slider 30 according to the modification has at least one hollow portion 33 that is separate from the slide groove 31. In the modification, six cylindrical hollow portions 33 are provided along the outer peripheral surface 30*a* and on the eccentric side of the slider 30 with respect to the center axis O1 of the slider 30. The hollow portions 33 may each be a through hole extending through the slider 30 in the axial direction or may be a non-through hole such as a recess or a counterbore. Since the hollow portions 33 are provided, the center of gravity G of the slider 30 is eccentric in the reverse eccentric direction from the axis of rotation O of the main shaft 7. The modification also produces the advantageous effect produced by the configuration illustrated in FIGS. 2 and 3.

As described above, the scroll compressor according to Embodiment includes the compressing mechanism unit 20 including the fixed scroll 3 that is fixedly provided in the shell 1 and the orbiting scroll 4 that moves around the fixed scroll 3, the compressing mechanism unit 20 compressing fluid; the main shaft 7 including the eccentric shaft portion 7*a* at one end thereof and that transmits the rotational driving force to the orbiting scroll 4; the slider 30 having the slide groove 31 in which the eccentric shaft portion 7*a* is slidably fitted; and the orbital bearing 14 provided to the orbiting scroll 4 and that rotatably supports the slider 30. The slider 30 is provided on the inner peripheral side of the orbital bearing 14 when seen in the direction of the center axis O1 of the slider 30. The center axis O1 of the slider 30 is eccentric in one direction from the axis of rotation O of the main shaft 7. The center of gravity G of the slider 30 is eccentric in a direction opposite to the one direction from the axis of rotation O of the main shaft 7.

Furthermore, in the scroll compressor according to Embodiment, the distance R between the center of gravity G of the slider 30 and the axis of rotation O of the main shaft 7 may be longer than the distance r between the center axis O1 of the slider 30 and the axis of rotation O of the main shaft 7.

Furthermore, in the scroll compressor according to Embodiment, the slider 30 may have the hollow portion 32 that is continuous with the slide groove 31.

Furthermore, in the scroll compressor according to Embodiment, the slider 30 may have hollow portions 33 that are separate from the slide groove 31.

Furthermore, in the scroll compressor according to Embodiment, the fluid may be an HFO refrigerant.

Furthermore, Embodiment and the modification thereof may be implemented in combination with each other.

REFERENCE SIGNS LIST

1 shell 2 frame 3 fixed scroll 3*a*, 4*a* base plate 3*b*, 4*b* scroll lap orbiting scroll 4*c* boss portion 5 stator 6 rotor 7 main shaft 7*a* eccentric shaft portion 8 lubricant 9 pump 10 suction pipe 11 discharge pipe 12 Oldham ring 14 orbital bearing 15 oil sump 16 main bearing unit 17 sub-bearing unit 18 sub-frame 20 compressing mechanism unit 21 electric motor unit 30 slider 30*a* outer peripheral surface 31 slide groove 32, 33 hollow portion 40 balance-weighted slider 41 slider portion 42 balance weight portion

The invention claimed is:

1. A scroll compressor comprising:

a compressing mechanism unit including a fixed scroll fixed in a shell and an orbiting scroll configured to move around the fixed scroll, the compressing mechanism unit being configured to compress fluid;

a main shaft including an eccentric shaft portion at one end and being configured to transmit a rotational driving force to the orbiting scroll;

a slider having a slide groove in which the eccentric shaft portion is slidably fitted; and an orbital bearing provided to the orbiting scroll and rotatably supporting the slider, wherein the slider is provided only on an inner peripheral side of the orbital bearing when seen in a direction of a center axis of the slider, the center axis of the slider is eccentric in one direction from an axis of rotation of the main shaft, the slider includes a balance weight portion for adjusting a center of gravity of the slider, and the center of gravity of the slider is eccentric in a direction opposite to the one direction from the axis of rotation of the main shaft.

2. The scroll compressor of claim 1, wherein a distance between the center of gravity of the slider and the axis of rotation of the main shaft is larger than a distance between the center axis of the slider and the axis of rotation of the main shaft.

3. The scroll compressor of claim 1, wherein the slider has a hollow portion that is continuous with the slide groove.

4. The scroll compressor of claim 1, wherein the fluid is an HFO refrigerant.

5. The scroll compressor of claim 1, wherein the hollow portion of the slider is configured to adjust the center of gravity of the slider.

6. The scroll compressor of claim 1, wherein the balance weight portion is configured not to project to an outer peripheral side of the orbital bearing.

7. A scroll compressor comprising:

a compressing mechanism unit including a fixed scroll fixed in a shell and an orbiting scroll configured to move around the fixed scroll, the compressing mechanism unit being configured to compress fluid;

a main shaft including an eccentric shaft portion at one end and being configured to transmit a rotational driving force to the orbiting scroll;

a slider having a slide groove in which the eccentric shaft portion is slidably fitted; and an orbital bearing provided to the orbiting scroll and rotatably supporting the slider; wherein the slider is provided only on an inner peripheral side of the orbital bearing when seen in a direction of a center axis of the slider, the center axis of the slider is eccentric in one direction from an axis of rotation of the main shaft, the slider includes a balance weight portion for adjusting a center of gravity of the slider, the center of gravity of the slider is eccentric in a direction opposite to the one direction from the axis of rotation of the main shaft, and the slider has a hollow portion that is separate from the slide groove.

* * * * *